US010138056B2

(12) United States Patent
Nakamura

(10) Patent No.: US 10,138,056 B2
(45) Date of Patent: Nov. 27, 2018

(54) DEVICE AND METHOD FOR SECURING BAGS WITHIN A CONTAINER

(71) Applicant: Maria Nakamura, Plantation, FL (US)

(72) Inventor: Maria Nakamura, Plantation, FL (US)

( * ) Notice: Subject to any disclaimer, the term of this patent is extended or adjusted under 35 U.S.C. 154(b) by 0 days.

(21) Appl. No.: 15/624,438

(22) Filed: Jun. 15, 2017

(65) Prior Publication Data

US 2017/0362025 A1 Dec. 21, 2017

Related U.S. Application Data

(60) Provisional application No. 62/350,206, filed on Jun. 15, 2016.

(51) Int. Cl.
*B65F 1/14* (2006.01)
*B65F 1/06* (2006.01)

(52) U.S. Cl.
CPC ..... *B65F 1/14* (2013.01); *B65F 1/06* (2013.01); *B65F 1/1415* (2013.01)

(58) Field of Classification Search
CPC .. B65F 1/14; B65F 1/06; B65F 1/1415; B65F 1/065; B65F 1/10; B65F 1/125; B65B 67/1238; B65B 67/12; B65B 67/1255; B65B 67/04; B65B 67/1222
USPC ..... 248/99, 101
See application file for complete search history.

(56) References Cited

U.S. PATENT DOCUMENTS 3,148,799 A * 9/1964 Meroney ..... B65F 1/0006 206/524.5
3,958,785 A * 5/1976 Aboud ..... B65B 67/1238 248/101
5,028,022 A * 7/1991 Metcalf ..... B65F 1/06 220/495.11
5,065,891 A * 11/1991 Casey ..... B65F 1/06 220/495.08
5,082,219 A * 1/1992 Blair ..... B65F 1/1415 141/390
5,803,299 A * 9/1998 Sealy, Jr. ..... B65F 1/062 220/495.07
5,816,431 A * 10/1998 Giannopoulos ..... B65F 1/06 220/495.11
6,728,996 B2 * 5/2004 Roscow ..... B65F 1/06 220/908
8,322,663 B2 * 12/2012 Bosik ..... B65B 67/1238 248/97
2003/0188398 A1 * 10/2003 Bathey ..... B65F 1/06 24/30.5 R
2012/0217247 A1 * 8/2012 Adkins ..... B65F 1/0006 220/495.08

(Continued)

*Primary Examiner* — Christopher Garft
(74) *Attorney, Agent, or Firm* — The Concept Law Group, PA; Scott M. Garrett

(57) ABSTRACT

A securing device for securing trash bags within a trash receptacle includes a belt member for securing a trash bag within a trash receptacle; and at least one resilient member coupled to the belt member at a first end of the at least one resilient member and operably configured to couple to an inner wall of the trash receptacle at a second end of the at least one resilient member, the at least one resilient member further operably configured to apply a biasing force against the inner wall of the trash receptacle to clamp the trash bag, without any other external forces, against the inner wall between the belt member and the inner wall.

19 Claims, 6 Drawing Sheets

(56) References Cited

U.S. PATENT DOCUMENTS

2015/0060460 A1* 3/2015 Corbitt ..... B65F 1/06
220/495.08

* cited by examiner

DEVICE AND METHOD FOR SECURING BAGS WITHIN A CONTAINER

CROSS-REFERENCE TO RELATED APPLICATION

This application claims priority to U.S. Provisional Patent Application No. 62/350,206 filed Jun. 15, 2016 the entirety of which is incorporated by reference.

FIELD OF THE INVENTION

The present invention relates generally to a device and method that secures bags within a container, and, more particularly, relates to a device and method for securing trash disposal bags to a trash receptacle.

BACKGROUND OF THE INVENTION

Users of waste pails/trash receptacles in areas such as a bathroom, kitchen, office, and other areas within a residence or workplace often place trash bags within such trash receptacles to receive the disposal of waste. Users of waste pails often find it unappealing and unslightly to have these bags exposed to outside view once they are secured to the waste pails.

For example, typically, the upper section of the trash bag is exposed near the top opening of the trash receptacle. In other words, the trash bag typically extends over a top rim of the trash receptacle and downwardly over an external surface of an upper portion of the trash receptacle sidewall, creating an eyesore. Additionally, some trash bags cannot be well-secured to the trash receptacle, particularly if the trash receptacle does not include a cover that retains the trash bag to the trash receptacle. Without a retention mechanism, these trash bags may fall entirely within the inner cavity of the trash receptacle, as a result of heavier trash items being placed within the trash bag. The consequences of this could include users continuously placing trash within the trash container but not within the trash bag, which may become very messy and inconvenient for individuals who are tasked with emptying the trash. In other words, the trash receptacle may be soiled by trash items not contained within the trash bag due to a displaced trash bag that becomes unsecured.

Therefore, a need exists to overcome the problems with the prior art as discussed above.

SUMMARY OF THE INVENTION

The invention provides a device and method for securing bags within a container that overcomes the hereinaforementioned disadvantages of the heretofore-known devices and methods of this general type.

With the foregoing and other object in mind, there is provided, in accordance with the invention, securing device including a belt member for securing a trash bag within a trash receptacle, and at least one resilient member coupled to the belt member at a first end of the at least one resilient member. The at least one resilient member is further operably configured to apply a biasing force against the inner wall of the trash receptacle to clamp the trash bag, without any other external forces, against the inner wall between the belt member and the inner wall.

In accordance with another feature, in one embodiment of the present invention, the belt member is formed as a strip of flexible material operably configured to conform to a shape of the inner wall of the trash receptacle.

In accordance with a further feature, in one embodiment of the present invention, the at least one resilient member is removably coupled to the inner wall of the trash receptacle.

In accordance with yet another feature, in one embodiment of the present invention, the at least one resilient member is removably coupled to the inner wall of the trash receptacle by an adhesive.

In accordance with another characteristic, in one embodiment of the present invention, the first end and the second end of at least one resilient member are opposite to each other and the at least one resilient member is oriented substantially perpendicular relative to an elongation direction of the belt member.

In accordance with another feature, in one embodiment of the present invention, the belt member extends circumferentially along the inner wall of the trash receptacle.

In accordance with a further feature, in one embodiment of the present invention, the at least one resilient member includes a plurality of resilient members disposed in a horizontally spaced apart arrangement along the inner wall of the trash receptacle.

In accordance with yet another feature, one embodiment of the present invention includes at least one wall-coupling member, the at least one wall-coupling member corresponding to the at least one resilient member, being coupled to the second end of the at least one resilient member and coupling the at least one resilient member to the inner wall.

In accordance with another characteristic, in one embodiment of the present invention, the at least one wall-coupling member is formed as a patch member.

Also in accordance with the invention, a securing device for securing trash bags within a trash receptacle is disclosed that includes a belt member for securing a trash bag within a trash receptacle; and at least one resilient member coupled to the belt member at a first end of the at least one resilient member and coupled to an inner wall of the trash receptacle at a second end of the at least one resilient member. The at least one resilient member is further operably configured to apply a biasing force against the inner wall of the trash receptacle to clamp the trash bag, without any other external forces, against the inner wall between the belt member and the inner wall.

In accordance with another feature, in one embodiment of the present invention, a portion of the at least one resilient member is fixedly connected to the inner wall of the trash receptacle.

In accordance with a further feature, in one embodiment of the present invention, the belt member is formed as a strip of flexible material operably configured to conform to a shape of the inner wall of the trash receptacle.

In accordance with another characteristic, in one embodiment of the present invention, the first end and the second end of at least one resilient member are opposite to each other and the at least one resilient member is oriented substantially perpendicular relative to an elongation direction of the belt member.

In accordance with yet another feature, in one embodiment of the present invention, the belt member extends circumferentially along the inner wall of the trash receptacle.

In accordance with another feature, in one embodiment of the present invention, the at least one resilient member includes a plurality of resilient members disposed in a horizontally spaced apart arrangement along the inner wall of the trash receptacle.

In accordance with a further feature, in one embodiment of the present invention, at least one wall-coupling member, the at least one wall-coupling member corresponding to the at least one resilient member, being coupled to the second end of the at least one resilient member and coupling the at least one resilient member to the inner wall.

In accordance with the present invention, a method of securing a trash bag within a trash receptacle is disclosed, the method comprising the step of providing a securing device within a trash receptacle, the securing device having a belt member for securing a trash bag within the trash receptacle, and at least one resilient member coupled to the belt member at a first end of the at least one resilient member and operably configured to couple to an inner wall of the trash receptacle at a second end of the at least one resilient member. The at least one resilient member is further operably configured to apply a biasing force against the inner wall of the trash receptacle to clamp the trash bag, without any other external forces, against the inner wall between the belt member and the inner wall. The method of securing the trash bag within the trash receptacle also includes the step of, after providing the securing device within the trash receptacle, inserting the trash bag into the trash receptacle. The method further includes the step of exerting a force against the at least one resilient member in a direction towards a center of the trash receptacle and away from the inner wall to create a gap between the inner wall and the belt member. After creating the gap between the inner wall and the belt member, the method includes the step of folding a top portion of the trash bag over the belt member and inserting the top portion into the gap. The method further includes the step of, after inserting the top portion into the gap, releasing the at least one resilient member against the inner wall of the trash receptacle for clamping the top portion of the trash bag between the inner wall and the belt member to secure the trash bag to the trash receptacle.

In accordance with another feature, in one embodiment of the present invention, after clamping the top portion of the trash bag, the method of securing the trash bag within the trash receptacle includes the step of exerting a second force against the at least one resilient member in the direction towards the center of the trash receptacle and away from the inner wall and removing the trash bag from the trash receptacle.

In accordance with a further feature, in one embodiment of the present invention, the step of providing the securing device within a trash receptacle further includes extending the belt member circumferentially along the inner wall of the trash receptacle and fastening opposite ends of the belt member to each other via at least one of an adhesive and a mechanical fastener.

In accordance with yet another feature, in one embodiment of the present invention, the trash receptacle provided during the first step of the method further includes a plurality of resilient members disposed in a horizontally spaced apart arrangement along the inner wall of the trash receptacle.

Although the invention is illustrated and described herein as embodied in a device and method for securing bags within a container, it is, nevertheless, not intended to be limited to the details shown because various modifications and structural changes may be made therein without departing from the spirit of the invention and within the scope and range of equivalents of the claims. Additionally, well-known elements of exemplary embodiments of the invention will not be described in detail or will be omitted so as not to obscure the relevant details of the invention.

Other features that are considered as characteristic for the invention are set forth in the appended claims. As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one of ordinary skill in the art to variously employ the present invention in virtually any appropriately detailed structure. Further, the terms and phrases used herein are not intended to be limiting; but rather, to provide an understandable description of the invention. While the specification concludes with claims defining the features of the invention that are regarded as novel, it is believed that the invention will be better understood from a consideration of the following description in conjunction with the drawing figures, in which like reference numerals are carried forward. The figures of the drawings are not drawn to scale.

Before the present invention is disclosed and described, it is to be understood that the terminology used herein is for the purpose of describing particular embodiments only and is not intended to be limiting. The terms "a" or "an," as used herein, are defined as one or more than one. The term "plurality," as used herein, is defined as two or more than two. The term "another," as used herein, is defined as at least a second or more. The terms "including" and/or "having," as used herein, are defined as comprising (i.e., open language). The term "coupled" and "couplable," as used herein, is defined as connected, although not necessarily directly, and not necessarily mechanically. The term "providing" is defined herein in its broadest sense, e.g., bringing/coming into physical existence, making available, and/or supplying to someone or something, in whole or in multiple parts at once or over a period of time.

As used herein, the terms "about" or "approximately" apply to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure. In this document, the term "longitudinal" should be understood to mean in a direction corresponding to an elongated direction of the belt.

BRIEF DESCRIPTION OF THE DRAWINGS

The accompanying figures, where like reference numerals refer to identical or functionally similar elements throughout the separate views and which together with the detailed description below are incorporated in and form part of the specification, serve to further illustrate various embodiments and explain various principles and advantages all in accordance with the present invention.

DETAILED DESCRIPTION

Figure 1:
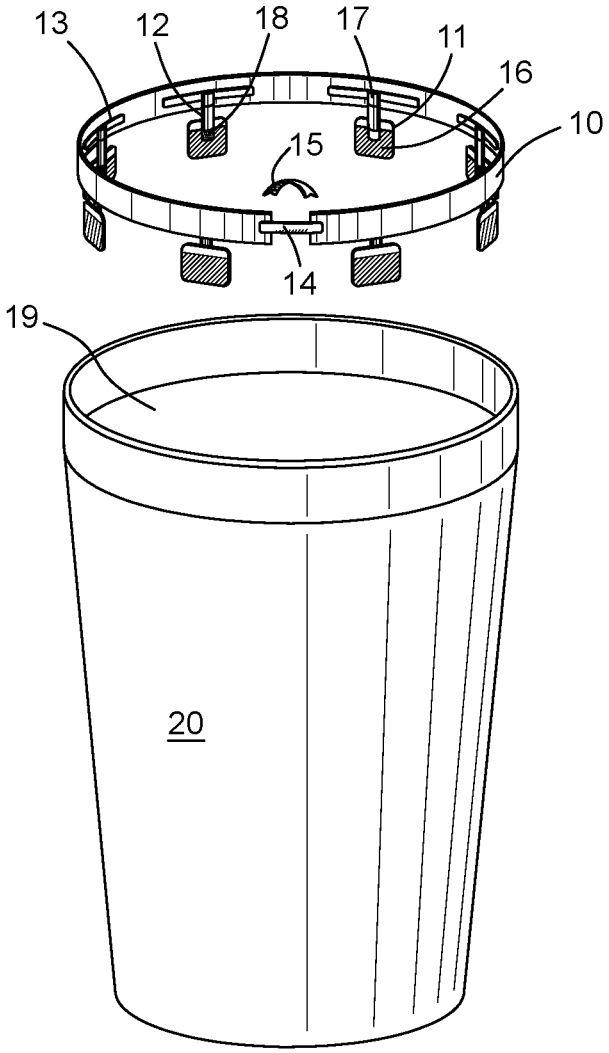
FIG. 1 is a perspective view of a trash receptacle and a securing device in accordance with an embodiment of the present invention.

While the specification concludes with claims defining the features of the invention that are regarded as novel, it is believed that the invention will be better understood from a consideration of the following description in conjunction with the drawing figures, in which like reference numerals are carried forward. It is to be understood that the disclosed embodiments are merely exemplary of the invention, which can be embodied in various forms.

The present invention provides a novel and efficient trash bag securing device for securing trash bags within a trash receptacle, while also eliminating top portions of the trash bag being exposed to external view. Embodiments of the invention provide for a belt member and at least one resilient member being coupled to an inner wall of the trash receptacle. In addition, embodiments of the invention provide that the resilient member is configured to apply a biasing force against the inner wall of the trash receptacle to clamp the trash bag, without any other external forces, against the inner wall between the belt member and the inner wall.

Referring now to FIG. 1, one embodiment of the present invention is shown in a perspective view. FIG. 1 shows several advantageous features of the present invention, but, as will be described below, the invention can be provided in several shapes, sizes, combinations of features and components, and varying numbers and functions of the components. The first example of a securing device 100, as shown in FIG. 1, includes a belt member 10 and at least one resilient member 12. The securing device 100 can be pre-installed or fixedly connected to a trash receptacle 20 during manufacturing of the trash receptacle 20, or, alternatively, the securing device 100 may be sold or otherwise provided separately from the trash receptacle 20 for selective use by consumers with pre-existing trash receptacles 20.

The belt member 10 may allow one or more clamps or resilient member(s) 12 to bend at one time for quicker trash bag 40 replacement. In other words, to secure the trash bag 40 to the trash receptacle 20, all the way around a circumference of the trash bag 40, all of the resilient member(s) 12 may preferably be bent down to be able to secure the trash bag 40 completely around its circumference (or more particularly the circumference of its top portion 42). The belt member 10 may come in different sizes and lengths and may be trimmable to accommodate the size and shape of any container but cutting said belt member 10. The belt member 10 is preferably formed as a strip of flexible material operably configured to conform to a shape of the inner wall 19 of the trash receptacle 20 (which may, for example, be cylindrical, or rectangular in other embodiments). In one embodiment, the belt member 10 may be sufficiently flexible to bend in various directions. The belt member 10 may be a strip of flexible polymer material and may also include reinforcement fabrics for strength. In other embodiments, the belt member 10 may be made of other flexible materials. In preferred embodiments, the belt member 10 is made of a material that is flexible, but also easily trimmable by an ordinary scissors to accommodate different size trash receptacles 20.

In one embodiment, opposite ends of the belt member 10 may be couplable to one another. In one exemplary embodiment, a buckle 14 may join the two ends of the belt member 10 together. An adhesive tape 15, or other coupling mechanism may secure the buckle 12 and belt member 10 together as a single circular unit, corresponding to the circular shape of the trash receptacle 20.

Figure 2:
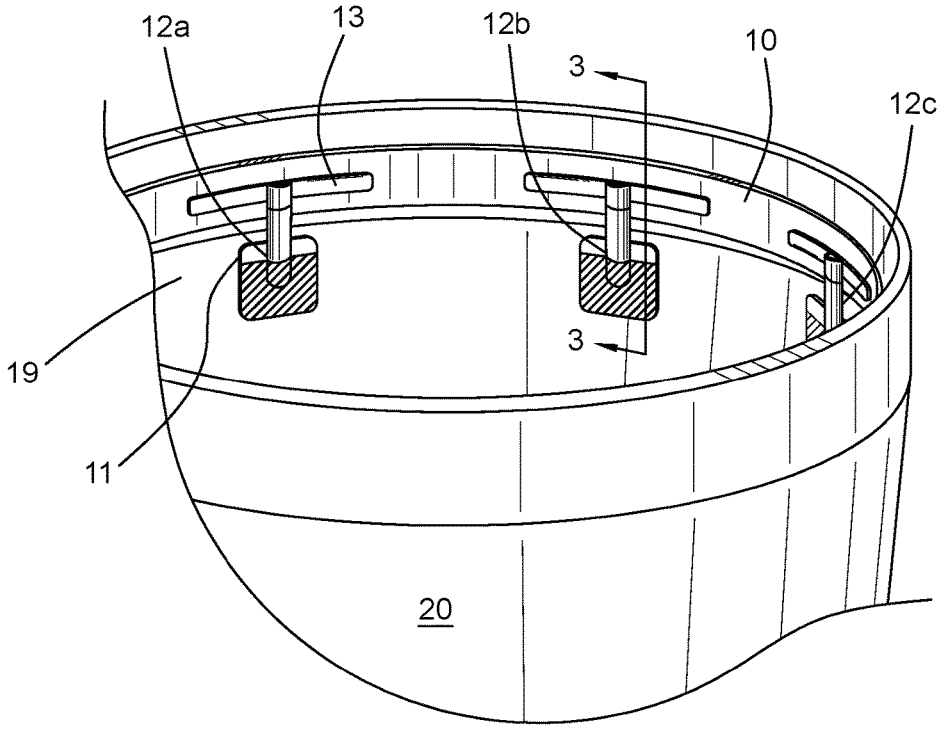
FIG. 2 is an enlarged partial perspective view of the securing device of FIG. 1 attached to the trash receptacle of FIG. 1, in accordance with the present invention.

In one embodiment, inner surfaces of the belt member 10 may be lined with a series of sheets or strips 13 that may be evenly spaced apart from each other, and extend horizontally along the inner surface of the belt member 10, as shown in FIGS. 1 and 2. Such strips 13 may be attached to the belt member 10 by, for example, a gluing agent, sealing agent, bonding agent, sewing, welding, thermal bonding, hooking mechanic, or the like. The strips 13 may assist with attaching the resilient member(s) 12 to the belt member 10 and may correspond to the resilient member(s) 12 in a one-to-one ratio.

In one embodiment, the resilient member 12 includes a first end 17 and a second end 18. The first end 17 and the second end 18 may be considered opposite ends of the resilient member 12. The resilient member(s) 12 may be attached to the strips 13 on one of its ends (the first end 17), and a wall-coupling member 11, which may be formed as a patch, may be attached on its opposite end (second end 18). The wall-coupling member 11 may couple directly to the inner wall 19 via, for example, an adhesive, thereby coupling the securing device 100, as a whole to the inner wall 19. In another embodiment, the securing device 100 may not include the wall-coupling patch member 11, but may be coupled to the inner wall 19 by other attachment mechanisms, or the resilient member 12 may be directly connected to, or integral with the inner wall 19.

In a preferred embodiment, the resilient member(s) 12 should be coupled to the belt member 10 at the first end 17 and should be operably configured to couple to the inner wall 19 of the trash receptacle 20 at its second end 18. Importantly, the resilient member(s) 12 should be operably configured to apply a biasing force 304 against the inner wall 19 to clamp the trash bag 40, without any other external forces, against the inner wall 19 between the belt member 10 and the inner wall 19.

The securing device 100 may include a plurality of resilient members 12, or may, in some embodiments, including a single elongated resilient member 12. The number of resilient members 12 within the securing device 100 can be any number. In one embodiment, the resilient members 12 may be removeably coupled to the inner wall 19, such as, for example, by an adhesive or mechanical fastener. In another embodiment, the resilient member(s) 12 are oriented substantially perpendicular (90 degrees+/−15 degrees) relative to an elongation direction of the belt member 10. In one embodiment, the resilient member(s) 12 are disposed in a horizontally spaced apart arrangement along the inner wall 19 of the trash receptacle 20.

In one embodiment, the resilient member 12 may be formed as a curved sheet metal strip 12. In such embodiment, the curved sheet metal strip 12 can be attached to 13 and 11 by, but not limited to, a gluing agent, sealing agent, bonding agent, sewing, welding, thermal bonding, hooking mechanic, or alike. The curvature in the curved sheet metal strips 12, seen closely in FIG. 5, may be configured to permit it to bend when force is exerted upon it, and bend back to its original state when the force exertion is ceased; such bending motion can be seen in FIG. 3.

The patch 11 may be made of a firm stiff material and can mold itself against curved surfaces. The patch 11 may have a sticking agent on one side in order to grip the inner walls 19 of the trash receptacle 20. In another embodiment, the patch 11 may also be attached to the trash receptacle 20 by, but not limited to, a gluing agent, sealing agent, bonding agent, sewing, welding, thermal bonding, hooking mechanic, or alike. On the patch's 11 other side, the side connected to the curved sheet metal strip 12, an adhesive tape 16 (e.g., double-sided tape) may be placed over the curved sheet metal strip 12. In one embodiment, the adhesive tape 16 further secures the curved sheet metal strip 12 to the patch 11. In other embodiments, the resilient member 12 may not be formed as a sheet metal strip, but may be formed of another resilient material.

Figure 3:
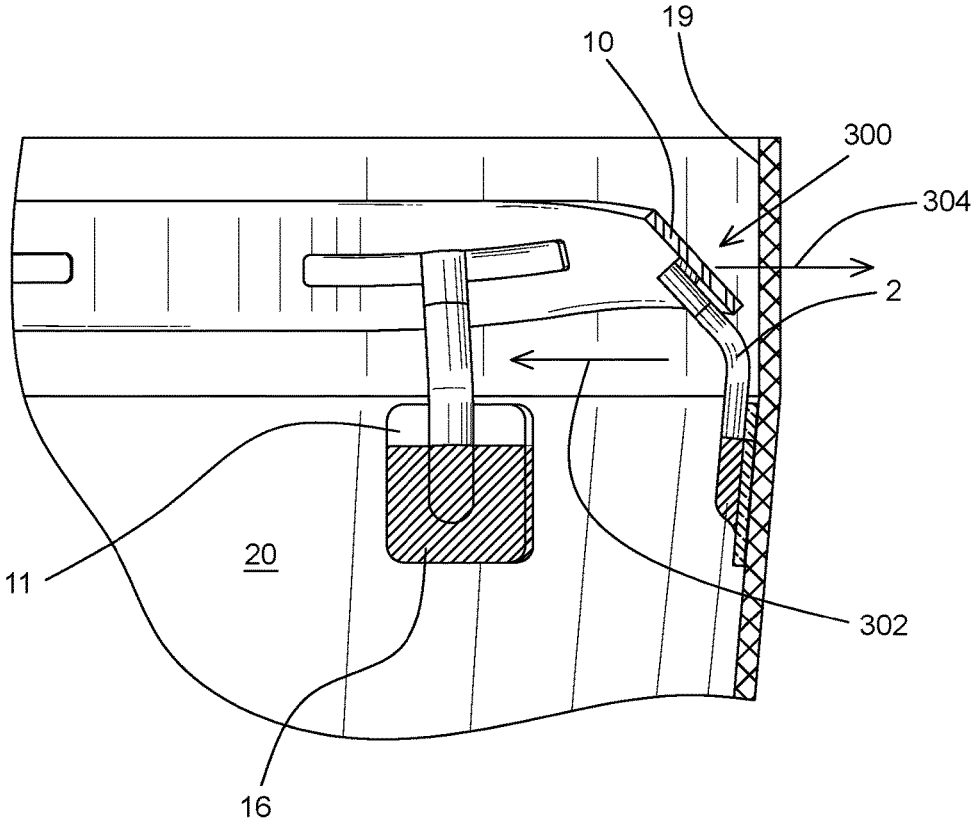
FIG. 3 is a sectional side view of the securing device of FIG. 1 attached to the trash receptacle of FIG. 1, partially bent inward to receive the trash bag for securing it to the trash receptacle, in accordance with the present invention.
Figure 4:
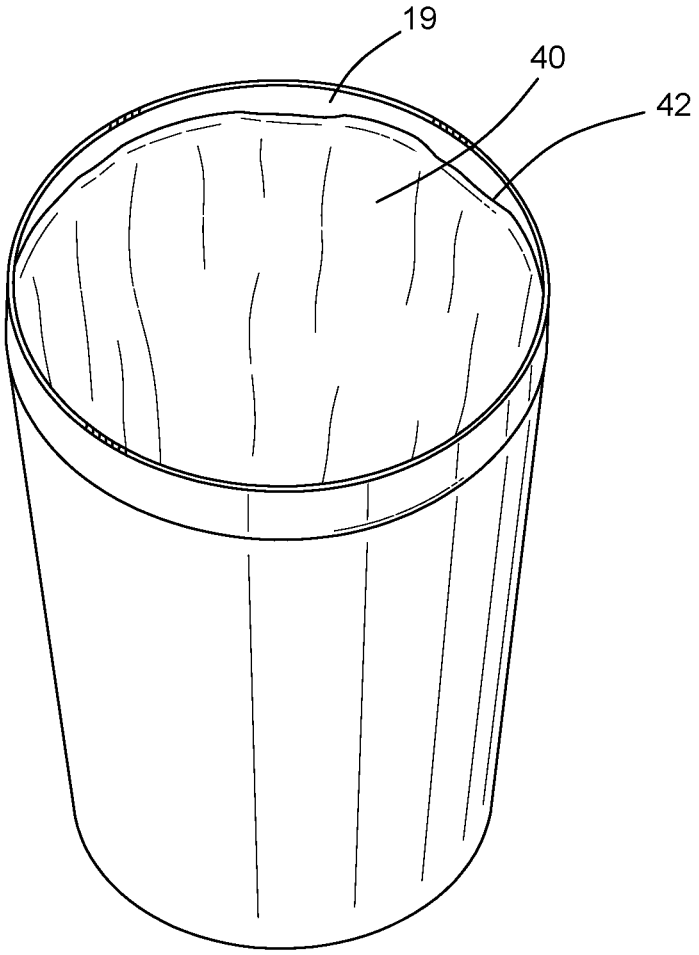
FIG. 4 is an enlarged partial perspective view of the trash bag secured to the trash receptacle by the securing device of FIG. 1, in accordance with an embodiment of the present invention.
Figure 5:
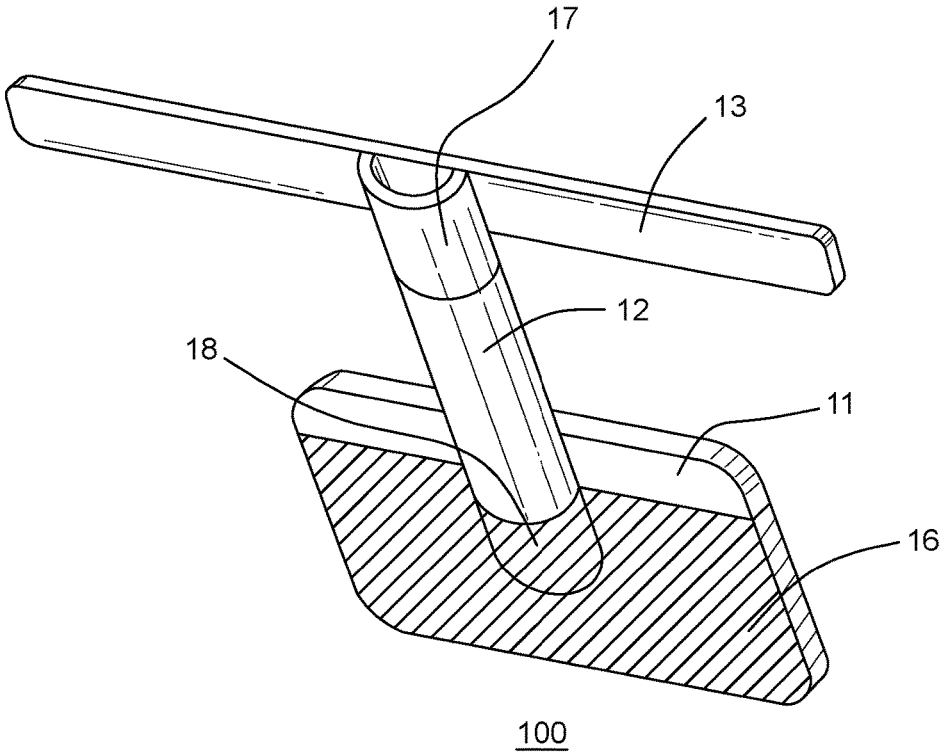
FIG. 5 is a perspective front view of a clamping feature of the securing device of FIG. 1, in accordance with an embodiment of the present invention.

Referring now primarily to FIG. 2, a positioning of the securing device 100 along the inner wall 19 is illustrated, with the belt member 10 being closely adjacent to the top of the trash receptacle 20. FIG. 3 illustrates the clamping/securing feature, showing an upper portion of the resilient member 12 bent forward or inward when a user force is exerted on the resilient member 12. FIG. 4 illustrates the trash bag 40 being secured in place within the trash receptacle 20 by the securing device 100, as will be described in more detail with reference to the flow chart depicted in FIG. 6. FIG. 5 illustrates a curvature in the curved sheet metal strip 12 and shows the patch 11 forming a tangent to the curved sheet metal strip's 12 curve.

Figure 6:
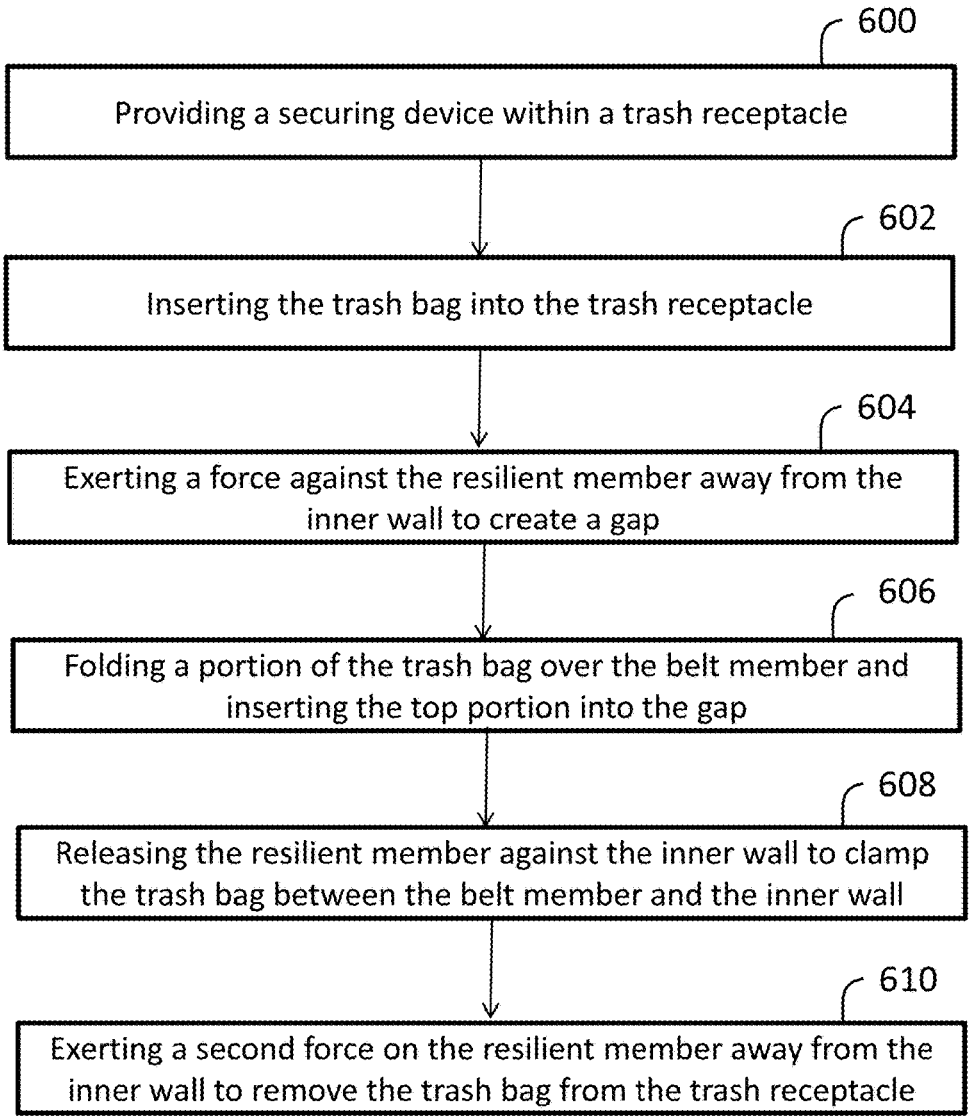
FIG. 6 is a flow chart depicting an exemplary process for using the securing device of FIG. 1, in accordance with an embodiment of the present invention.

FIGS. 1-5 will now be described in conjunction with the process flow chart of FIG. 6. Although FIG. 6 shows a specific order of executing the process steps, the order of executing the steps may be changed relative to the order shown in certain embodiments. Also, two or more blocks shown in succession may be executed concurrently or with partial concurrence in some embodiments. Certain steps may also be omitted in FIG. 6 for the sake of brevity.

In step 600, the process may begin by providing the securing device 100 within the trash receptacle 20. Such step may include extending the belt member 10 circumferentially along the inner wall 19 of the trash receptacle 20 and fastening opposite ends of the belt member 10 to each other via an adhesive or a mechanical fastener (e.g., buckle). The resilient fastening member(s) 12 may be coupled to the inner wall 19 of the trash receptacle 20, by, for example, an adhesive or a mechanical fastener. In one embodiment, the patch 11 may couple the resilient member(s) 12 to the inner wall 19 by itself being coupled to the inner wall 19, with the resilient member(s) 12 being connected to the patch 11. The belt member 10 may be considered a free end of the securing device 100, being retained against the inner wall 19 primarily by the biasing force 304 of the resilient member(s) 12 toward the inner wall 19 (as shown in FIG. 3).

In step 602, the trash bag 40 may be inserted into the trash receptacle 20. In step 604, with the resilient member(s) 12 coupled to the inner wall 19, a user may exert a force (e.g., a pulling force) on/against the resilient member 12 to create a gap 300 between the belt member 10 and the inner wall 19 (see FIG. 3). The force should move the resilient member 12 in a direction 302 towards a center of the trash receptacle 20. In step 606, the user may fold a portion of the trash bag 40 over the belt member 10, as shown in FIG. 4, and insert the top portion 42 of the trash bag 40 into the gap 300. In step 608, the user may release the resilient member(s) 12 against the inner wall 19 for clamping the top portion 42 of the trash bag 40 between the inner wall 19 and the belt member 10 thereby securing the trash bag 40 to the trash receptacle 20, while also keeping the entire trash bag 40 inside the trash receptacle 20, as can be seen in FIG. 4. Stated another way, with conventional trash bin bags the top portion 42 of the trash bag 40 is typically folded over the rim of the trash bin and thereby provides an eyesore to external observers. Advantageously, the present invention secures the trash bag 40 entirely within the trash receptacle 20 and is itself secured within the trash receptacle 20, such that no portion of the trash bag 40 or the securing device 100 hangs (or otherwise extends) outside of the trash receptacle 20, presenting an improvement over conventional trash bags 40. Once the trash bag 40 is ready to be emptied, the user can, in step 610, conveniently exert a second force against the resilient member(s) 12 in the direction away from the inner wall 19 so as to be able to remove the trash bag 40 from the receptacle 20.

A novel and efficient trash bag securing device for securing trash bags within a trash receptacle has been disclosed that also eliminates top portions of the trash bag being exposed to external view. Embodiments of the invention provide for a belt member and at least one resilient member being coupled to an inner wall of the trash receptacle. In addition, embodiments of the invention provide that the resilient member is configured to apply a biasing force against the inner wall of the trash receptacle to clamp the trash bag, without any other external forces, against the inner wall between the belt member and the inner wall.

What is claimed is:

1. A securing device for securing trash bags entirely within a trash receptacle comprising:

a belt member for securing a trash bag within the trash receptacle and configured to conform to an inner wall of the trash receptacle at a top of the trash receptacle and to clamp a top portion of the trash bag between the belt member and the inner wall of the trash receptacle without the top portion of the trash bag extending over the top of the trash receptacle;

at least one resilient member coupled to the belt member at a first end of the at least one resilient member and operably configured to couple to the inner wall of the trash receptacle, below the belt member, at a second end of the at least one resilient member, the at least one resilient member biasing the belt member against the inner wall of the trash receptacle to clamp the trash bag, without any other external forces, against the inner wall between the belt member and the inner wall.

2. The securing device in accordance with claim 1, wherein:

the securing device is removeably coupled to the inner wall of the trash receptacle.

3. The securing device in accordance with claim 1, wherein:

the securing device is removeably coupled to the inner wall of the trash receptacle by an adhesive.

4. The securing device in accordance with claim 1, wherein:

the first end and the second end of at least one resilient member are opposite to each other and the at least one resilient member is oriented substantially perpendicular relative to an elongation direction of the belt member.

5. The securing device in accordance with claim 1, wherein:

the belt member extends circumferentially and continuously along the inner wall of the trash receptacle.

6. The securing device in accordance with claim 1, wherein:

the at least one resilient member includes a plurality of resilient members disposed in a horizontally spaced apart arrangement along the inner wall of the trash receptacle.

7. The securing device in accordance with claim 1, further comprising:

at least one wall-coupling member, the at least one wall-coupling member corresponding to the at least one resilient member, being coupled to the second end of the at least one resilient member and coupling the at least one resilient member to the inner wall.

8. The securing device in accordance with claim 7, wherein:

the at least one wall-coupling member is formed as a patch member.

9. A securing device for securing trash bags entirely within a trash receptacle comprising:

a belt member for securing a trash bag within the trash receptacle, the belt member configured to conform to the inner wall of the trash receptacle at a top of the trash receptacle;

a plurality of resilient members coupled to the belt member, each resilient member coupled to a portion of the belt member at a first end of the resilient member and coupled to an inner wall of the trash receptacle at a second end of the resilient member, each of the plurality of resilient members further operably configured to apply a biasing force to the belt member against the inner wall of the trash receptacle to clamp a top portion of the trash bag against the inner wall between the belt member and the inner wall without the top of the trash bag extending over a top of the trash receptacle.

10. The securing device in accordance with claim 9, wherein:

a portion of each of the plurality of resilient members is fixedly connected to the inner wall of the trash receptacle.

11. The securing device in accordance with claim 9, wherein:

the belt member is formed as a strip of flexible material operably configured to conform to a shape of the inner wall of the trash receptacle.

12. The securing device in accordance with claim 9, wherein:

the first end and the second end of each resilient member are opposite to each other and the at least one resilient member is oriented substantially perpendicular relative to an elongation direction of the belt member.

13. The securing device in accordance with claim 9, wherein:

the belt member extends circumferentially along the inner wall of the trash receptacle.

14. The securing device in accordance with claim 9, wherein:

the resilient member are disposed in a horizontally spaced apart arrangement along the inner wall of the trash receptacle.

15. The securing device in accordance with claim 9, further comprising:

a plurality of wall coupling members, each corresponding being coupled to the second end of the at least one resilient member and coupling the at least one resilient member to the inner wall.

16. A method for securing a trash bag within a trash receptacle comprising:

providing a securing device within a trash receptacle, the securing device having:

a belt member for securing a trash bag within the trash receptacle; and at least one resilient member coupled to the belt member at a first end of the at least one resilient member and operably configured to couple to an inner wall of the trash receptacle at a second end of the at least one resilient member, the at least one resilient member further operably configured to apply a biasing force against the inner wall of the trash receptacle to clamp the trash bag, without any other external forces, against the inner wall between the belt member and the inner wall;

after providing the securing device within the trash receptacle, inserting the trash bag into the trash receptacle;

exerting a force against the at least one resilient member in a direction towards a center of the trash receptacle and away from the inner wall to create a gap between the inner wall and the belt member;

after creating the gap between the inner wall and the belt member, folding a top portion of the trash bag over the belt member and inserting the top portion into the gap; and after inserting the top portion into the gap, releasing the at least one resilient member against the inner wall of the trash receptacle for clamping the top portion of the trash bag between the inner wall and the belt member to secure the trash bag to the trash receptacle.

17. The method in accordance with claim 16, further comprising:

after clamping the top portion of the trash bag, exerting a second force against the at least one resilient member in the direction towards the center of the trash receptacle and away from the inner wall and removing the trash bag from the trash receptacle.

18. The method in accordance with claim 17, wherein the step of providing the securing device within a trash receptacle further comprises:

extending the belt member circumferentially along the inner wall of the trash receptacle and fastening opposite ends of the belt member to each other via at least one of an adhesive and a mechanical fastener.

19. The method in accordance with claim 17, wherein the step of providing the securing device within a trash receptacle further comprises:

the at least one resilient member includes a plurality of resilient members disposed in a horizontally spaced apart arrangement along the inner wall of the trash receptacle.

* * * * *